US006306230B1

(12) United States Patent
Hengerer

(10) Patent No.: US 6,306,230 B1
(45) Date of Patent: Oct. 23, 2001

(54) PROCESS FOR THE PRODUCTION OF HARDENED PARTS OF STEEL

(75) Inventor: Frank Hengerer, Schwebheim (DE)

(73) Assignee: SKF GmbH (DE)

( * ) Notice: Subject to any disclaimer, the term of this patent is extended or adjusted under 35 U.S.C. 154(b) by 0 days.

(21) Appl. No.: 09/313,109

(22) Filed: May 17, 1999

(30) Foreign Application Priority Data

May 15, 1998 (DE) ..... 198 21 797

(51) Int. Cl.[7] ..... C21D 1/18; C21D 1/19

(52) U.S. Cl. ..... 148/653; 148/906; 148/605; 148/609

(58) Field of Search ..... 148/333, 334, 148/336, 653, 654, 906, 605, 609

(56) References Cited

U.S. PATENT DOCUMENTS

| | | | | |
|---|---|---|---|---|
| Re. 33,006 | * | 8/1989 | Hataya et al. | 165/134.1 |
| 4,457,789 | * | 7/1984 | Wilks | 148/134 |
| 4,671,827 | | 6/1987 | Thomas et al. . | |
| 5,122,198 | * | 6/1992 | von Hagen et al. | 148/651 |
| 5,294,271 | * | 3/1994 | Suzaki et al. | 148/580 |
| 5,449,420 | * | 9/1995 | Okada et al. | 148/333 |
| 5,509,977 | * | 4/1996 | Yano et al. | 148/328 |
| 5,527,401 | * | 6/1996 | Kim | 148/648 |
| 5,554,233 | | 9/1996 | Heitmann et al. . | |
| 5,616,187 | * | 4/1997 | Nelson | 148/333 |

FOREIGN PATENT DOCUMENTS

| | | | | |
|---|---|---|---|---|
| 1188574 | | 7/1967 | (GB) . | |
| 361009519A | * | 1/1986 | (JP) | 148/653 |

* cited by examiner

*Primary Examiner*—Roy King
*Assistant Examiner*—Harry D. Williams, III
(74) *Attorney, Agent, or Firm*—Eugene E. Renz, Jr. , PC

(57) ABSTRACT

A method for producing hardened parts of steel from an air-hardening steel comprising the steps of heating the steel is heated to a temperature above 1,100° C., hot-working the steel parts until they reach the $A_1$ emperature, cooling the steel parts in air to about 280° C. under simultaneous thermo-mechanical sizing treatment, then cooling the steel parts in air to room temperature, stress relief treating the steel parts at 150–250° C., and hard-machining the steel parts.

3 Claims, 1 Drawing Sheet

PROCESS FOR THE PRODUCTION OF HARDENED PARTS OF STEEL

FIELD OF THE INVENTION

The present invention relates to improvements in a process for the production of hardened steel parts.

BACKGROUND OF THE INVENTION

The highly stressed and wear-resistant parts of ball and roller bearings, gear transmissions, etc., which are subjected to rolling fatigue must be hardened. A steel with approximately 1 wt. % of carbon, i.e., a so-called roller bearing steel (e.g., 100 Cr 6), is usually used for these parts. It is usually heated to a temperature above 1,100° C., shaped into tubes or bars, cooled, given an intermediate annealing, soft-machined, hardened, and then finish-ground.

In the production of parts of roller bearing steel (100 Cr 6), therefore, it is necessary to conduct an expensive soft annealing process between the shaping and the other operations to ensure that mechanical processing can be carried out easily and that the parts can be hardened readily. It is also known that rings of roller bearing steel can be subjected to thermo-mechanical treatments. These are processes in which shaping and a heat treatment are combined effectively with each other. These processes make it possible to harden the parts from the heat of working, so that specific material properties can be improved and/or so that the heat treatment part of the process can substitute for another, i.e. separate heat treatment. In particular, the otherwise conventional soft annealing can be omitted, which means that the amount of energy required is reduced (see, for example, the German journal Stahl und Eisen, Vol. 108, No. 12, pp. 595–603, 1988).

In these known processes, the rings are first rolled and then quenched via $A_1$ from the heat of working. They are then annealed (hardened and tempered) and hard-machined. In most cases, however, a soaking furnace must be placed after the working operation to achieve a higher degree of process reliability and uniformity. Quenching usually takes place in a brine or oil bath. The distortions which thus occur, however, must always be corrected by expensive hard machining.

SUMMARY OF THE INVENTION

With the foregoing in mind, it is an object of the present invention to provide an improved process for the production of hardened parts of steel which not only requires a smaller amount of energy and is therefore less expensive but also yields parts of greater dimensional accuracy, so that little or no reworking is required. This task is accomplished according to the invention by means of a process wherein the steel is an air-hardenable steel and heated to a temperature above approximately 1,100° C. The parts are then hot-worked until they reach the $A_1$ temperature of about 800° C. as shown on the chart. The parts are then cooled in air to about 280° C. under simultaneous thermo-mechanical sizing treatment. The parts are then cooled in air to room temperature. A stress-relief treatment is conducted at 150–250° C.; and finally the parts hard-machined if necessary.

According to another feature of the invention, a steel with the following composition (in wt. %) can be selected as a suitable air-hardening steel:

0.5–0.9% carbon (C),

0–1.0% manganese (Mn),

0–2.0% silicon (Si),

0–2.0% nickel (Ni),

0–0.7% molybdenum (Mo),

0–2.0% chromium (Cr),

0–0.3% vanadium, and the remainder iron and the normal impurities.

It is preferred to use a steel with:

0.7% C, 0.3% Mn, 1.5% Si, 1.0% Ni, 0.17% Mo, 1.4% Cr, and the remainder iron and the normal impurities.

BRIEF DESCRIPTION OF THE DRAWINGS

These and other objects of the present invention and various features and details of the operation and construction thereof are hereinafter more fully set forth with reference to the accompanying drawings, wherein.

DESCRIPTION OF THE METHOD AND SYSTEM

Figure 1:
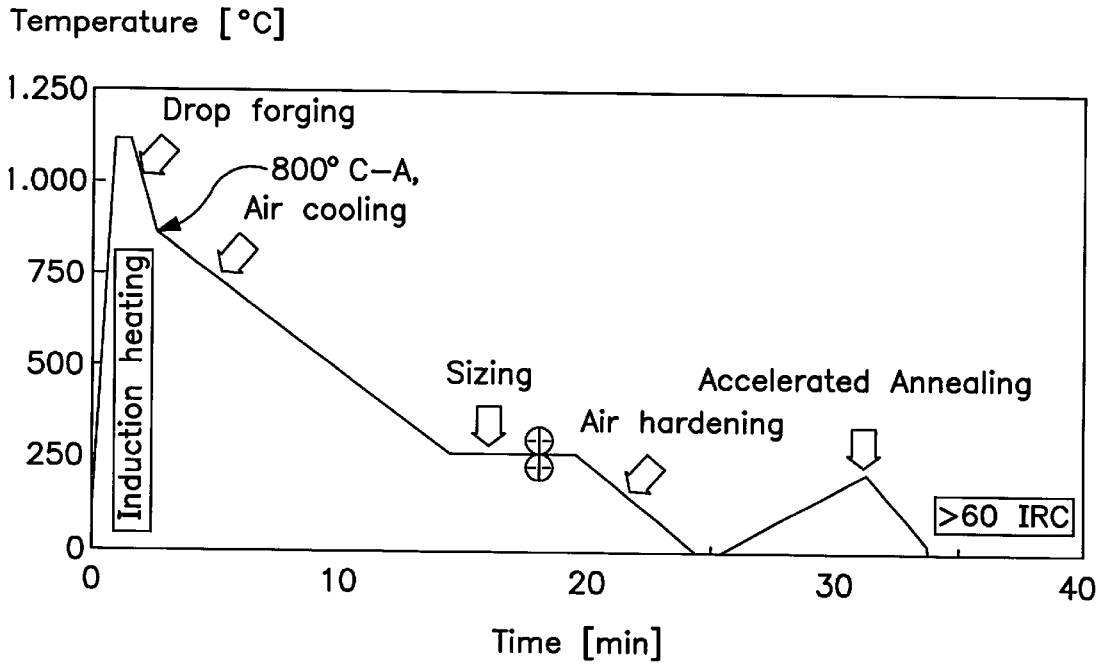
FIG. 1 is a chart showing the process parameters of the present invention.

The particular advantage of the process according to the invention is that the sizing of the parts by means of the thermo-mechanical treatment makes it possible to achieve such close dimensional tolerances that little or no hard machining of the parts is required. At the same time, the soft annealing and the soft machining operations can be omitted, so that not only energy costs but also the number of processing steps can be reduced. The cooling step after the hot working can be conducted in moving air, so that it is also possible to eliminate the brine or oil bath. In accordance with another feature of the invention, this approach to cooling makes it possible to size the parts at temperatures just above the martensite starting temperature, because now there is sufficient time available for the shaping operation.

The thermo-mechanical sizing treatment is carried out at any desired temperature between the final forging temperature and the martensite temperature, namely, at about 280° C., so that the parts can be sized to their final dimensions or nearly to their final dimensions. The further cooling in air then produces the desired martensite structure, so that the only step necessary after that is stress-relieving treatment at about 200° C.

The short annealing method described in DE Patent No. 4,007,487 can be used for the stress-relieving treatment.

If hard machining is required, it can take the form of grinding or hard turning. Thanks to the close tolerances reached by the thermo-mechanical sizing, the allowances left on the workpieces can be much smaller than those of conventional production.

The parts thus manufactured can be roller bearing parts, especially bearing rings, or transmission parts (gear wheels) or other types of forgings.

An example of the process according to the invention is described in the attached chart.

A steel with 0.7% C, 0.3% Mn, 1.5% Si, 1.0% Ni, 0.17% Mo, and 1.4% Cr, is heated by induction to about 1,120° C. and held briefly at this temperature. Then a forging operation is carried out, by means of which the blanks are brought into rough shape in a Hatebur press. This is followed by further cooling in air over the course of less than 12 minutes to a temperature of 250–300° C. In the next step, the blanks are sized at approximately 280° C., whereupon they are cooled further to room temperature. A short-term annealing treatment comes next, during which the parts reach a hardness of >60 HRC. Depending on the required accuracy of the parts, they can then be hard-machined also if necessary.

In this process according to the invention, the steps of soft annealing, soft machining, and quenching in systems specifically built for these purposes can be eliminated. The associated logistical advantages and shorter cycle times are obvious. In spite of the higher prices of the higher-alloyed steels, the much smaller energy requirement and the omission of machining passes still lead to significant cost savings.

Even though a particular embodiment of the invention has been illustrated and described herein, it is not intended to limit the invention and changes and modifications may be made therein within the scope of the following claims for example.

What is claimed is:

1. A method for producing hardened parts of steel comprising the steps in the sequence of:

heating steel parts to a temperature of about 1,100° C.;

hot-working the steel parts to about the $A_1$ temperature;

cooling the steel parts in air to about 280° C.;

while simultaneously sizing the steel parts with a thermomechanical process at a temperature between said $A_1$ temperature and the martensite temperature;

then cooling the steel parts to room temperature in an air hardening process;

annealing the steel parts at between about 150°–250° C. to a hardness greater than 60 HRC; and machining the steel parts to dimensional accuracy.

2. A method for producing hardened parts of steel having a chemical composition comprising 0.5–0.9% carbon (C), 0–1.0% manganese (Mn), 0–2.0% silicon (Si), 0–2.0% nickel (Ni), 0–0.7% molybdenum (Mo), 0–2.0% chromium (Cr), 0–0.3% vanadium, and the remainder iron and the normal impurities and processed in a manner to produce parts having hard surfaces for repeated cycles of rolling contact comprising the steps in the sequence of:

heating steel parts to a temperature of about 1,100° C.;

hot-working the steel parts to about the $A_1$ temperature;

cooling the steel parts in air to about 280° C.;

while simultaneously sizing the steel parts with a thermomechanical process at a temperature between said $A_1$ temperature and the martensite temperature;

then cooling the steel parts to room temperature in an air hardening process;

annealing the steel parts at between about 150°–250° C. to a hardness greater than 60 HRC; and machining the hardened steel parts to dimensional accuracy.

3. A method for producing hardened parts of steel having a chemical composition comprising 0.5–0.9% carbon (C), 0–1.0% manganese (Mn), 0–2.0% silicon (Si), 0–2.0% nickel (Ni), 0–0.7% molybdenum (Mo), 0–2.0% chromium (Cr), 0–0.3% vanadium, and the remainder iron and the normal impurities and processed in a manner to produce parts having hard surfaces for repeated cycles of rolling contact comprising the steps in the sequence of:

heating steel parts to a temperature of about 1,100° C.;

hot-working the steel parts to about the $A_1$ temperature;

cooling the steel parts in air to about 280° C.;

while simultaneously sizing the steel parts with a thermomechanical process at a constant temperature between said $A_1$ temperature and the martensite temperature;

then cooling the steel parts to room temperature in an air hardening process;

annealing the steel parts at between about 150°–250° C. to a hardness greater than 60 HRC; and machining the hardened steel parts to dimensional accuracy.

* * * * *